United States Patent [19]

Weinberg

[11] 4,238,563

[45] Dec. 9, 1980

[54] RADIOGRAPHIC IMAGE ENHANCEMENT

[75] Inventor: Norman L. Weinberg, Amherst, N.Y.

[73] Assignee: Minrad Corporation, East Amherst, N.Y.

[21] Appl. No.: 971,922

[22] Filed: Dec. 21, 1978

Related U.S. Application Data

[63] Continuation-in-part of Ser. No. 848,993, Nov. 11, 1977, abandoned.

[51] Int. Cl.[3] ..... G03C 7/00; G03C 1/92

[52] U.S. Cl. ..... 430/367; 430/370; 430/432; 430/463; 430/966

[58] Field of Search ..... 96/58, 60 R, 82, 45.1; 250/477, 478; 430/432, 363, 463, 367, 966, 370, 967, 461, 430, 373

[56] References Cited

U.S. PATENT DOCUMENTS

| | | | |
|---|---|---|---|
| 2,699,994 | 1/1955 | Umberger | 96/58 |
| 3,083,097 | 3/1963 | Lässig et al. | 96/60 R |
| 3,753,714 | 8/1973 | Sugiyama et al. | 96/82 |

OTHER PUBLICATIONS

British Journal of Photography, Jun. 1916, vol. 63, pp. 357–358.

Amateur Photographer & Photography, Jun. 1923, pp. 567–568.

PhotoTechnique, Oct. 1940, pp. 42–46.

British Journal of Photography, Aug. 1955, pp. 376–377.

Neblette, Photography 1952, pp. 351–363.

*Primary Examiner*—Mary F. Downey

*Attorney, Agent, or Firm*—Howard M. Ellis

[57] ABSTRACT

A process for reducing patient and personnel hazards from exposure to X-radiation during diagnostic procedures, comprising irradiating a photographic emulsion to produce an underexposed radiograph, developing and fixing the radiograph and treating the underexposed processed radiograph in a one-step copper ion image enhancement composition to intensify the image profile to a level at least equivalent to a fully exposed radiograph. The copper ion image enhancement composition enables a reduction in radiation exposure to patient and personnel up to 50% and more over what is generally regarded as the usual and permissible level of radiation for a given diagnostic radiographic examination.

22 Claims, No Drawings

RADIOGRAPHIC IMAGE ENHANCEMENT

CROSS REFERENCE TO RELATED APPLICATION

This application is a continuation-in-part of Application Ser. No. 848,993, filed Nov. 11, 1977, now abandoned.

BACKGROUND OF THE INVENTION

This invention relates generally to a method for reducing the risk of illness or bodily injury arising from exposure to radiation during diagnostic procedures.

It is a well established medical fact that ionizing radiation such as emitted from X-ray equipment is capable of causing injury to both soft and hard body tissues. Principal damaging effects are usually observed as superficial injuries to the skin, general adverse effects to the body, particularly to the blood-forming organs, induction of tumors, miscellaneous effects such as cataracts, impaired fertility and adverse genetic effects. It has also been observed that tumor-inducing dosages of X-radiation will vary among persons who are exposed, typically, to low radiation doses. Hence, the minimum dose of radiation that causes tumors has not been established, notwithstanding that permissible levels of exposure are generally known which constitute an acceptable risk factor. In "*Medical and Dental X-Rays*", by P. W. Laws, (Health Research Group, Washington, 1974), it is pointed out that exposure to any amount of radiation is potentially harmful, yet it is possible for patients receiving a full series of diagnostic abdominal X-rays in a given year to exceed the annual occupational limit for radiation dose. Appendix D of this book compares the average doses for typical diagnostic X-ray examinations with the estimated annual excess deaths per million examinations. It is estimated that there are 30–100 excess deaths per million examinations for upper GI, 25–80 for lower GI, 5–20 for mammography, 2–7 for skull, 2–6 for dental (whole mouth) and 2–6 for chest (fluoroscopic examination). The numbers quoted above are in proportion to the estimated whole body equivalent does to which the patient is subjected. P. W. Laws concludes that if the radiation exposure can be reduced in these diagnostic procedures, it follows that the cancer risk is likewise reduced.

It has now been discovered that by underexposing a light sensitive radiograph, such as an X-ray film, to reduced levels of radiation, such that the processed film provides inadequate detail for diagnostic purposes, the image of the underexposed film can be subsequently enhanced to an image density profile equivalent to a fully exposed radiograph. A fully exposed radiograph for purposes of this invention is one in which the image detail is sufficiently distinct to the qualified observer. Radiographic image enhancement is accomplished by treating the developed and fixed film with a single-step copper ion image enhancement composition. Thus, the present invention provides a desirable means for reducing the previously accepted dosages of radiation exposure by up to 50%, and more.

Earlier efforts towards image enhancement of underexposed radiographs have not been entirely satisfactory. Chemical toners/intensifiers have been used heretofore; however, because their use required a multiplicity of processing steps they have not received wide acceptance. In addition, their highly corrosive properties and lack of stability have led to the use of additives, which in many instances were toxic substances. Furthermore, their high cost made the toning compositions economically unattractive. Still other earlier methods required the use of specially treated films, screens and apparatus, including viewing filters in order to achieve the desired image density. For example, U.S. Pat. No. 3,753,714 requires a fluorescent intensifying screen on one side of the light sensitive film. In addition, U.S. '714 generally recommends a multiple bath intensifying treatment wherein the image is blackened with a reducing substance in the second bath.

U.S. Pat. No. 2,699,994 to Umberger discloses a blue-colored iron toning bath whereby underexposed X-ray film is treated for image enhancement. Because of corrosive properties and stability problems associated with this toning formulation, additives of alpha-ether carboxylic acid e.g. diglycolic acid are required. However, it has been discovered that alpha-ether carboxylic acid compounds when used in place of more conventional sequestering agents e.g. . . . sodium citrate etc., are incompatible with copper salts in solution with ferricyanide ions causing the formation of an unacceptable precipitate. Umberger subsequently reported in the July, 1955 issue of *X-Ray Technician* page 19 et. seq., that toning intensification may be a means for reducing radiation to patients, but the author states that the blue toner of his U.S. Pat. No. 2,699,994 results in some increase in graininess in the intensified radiographs.

Another intensifier, Kodak Intensifier In-6, consists of three stock solutions that may be kept for several months. However, when mixed the intensifier is stable for only 2 to 3 hours and can be used only one time. Hence the brief shelf life of the prepared composition obviates repeated use of the solution.

U.S. Pat. No. 2,662,014 discloses yet another method of increasing image intensity through the use of chemical toners. However, additional processing steps are required whereby toning is preceded with a bleaching bath subsequent to developing and fixing.

Thus, according to the present invention underexposed radiographs made from radiation levels below those normally regarded as permissible and safe for diagnostic procedures for both hard and soft tissues, can be treated with a single bath, copper ion image enhancement composition to increase image density profile to a level at least equivalent to a fully exposed radiograph. The mixed copper ion image enhancement composition per se remains stable over many months, requiring no additional chemical additives or special stabilizers, can be used repeatedly without markedly exhausting the effectiveness of the bath composition, and requires no modification to either radiographic equipment or film.

In addition, the present invention has the added benefit of permitting recovery of the original silver image by simply treating the enhanced film in ordinary developing solutions, thus allowing personnel to verify the absence of false or other undesirable information. The original image can, once again, be re-enhanced in the single solution copper ion bath to obtain the enhanced image intensified by up to 50% and more.

Accordingly, it is a principal object of the present invention to provide a method for reducing patient and personnel risks arising from exposure to harmful radiation during diagnostic procedures.

It is a further object to provide a method for enhancing underexposed radiographs by means of a single step, copper ion enhancement composition to achieve an image quality at least equivalent to a fully exposed radiograph.

A still related object of the instant invention is to provide an enhancement bath for intensifying underexposed radiographs which will remain stable for prolonged time periods and can be used repeatedly.

Yet still another object of the present invention is to provide a method for enhancing the image density profile of underexposed radiographs following which the original underexposed radiograph may be recovered by redevelopment.

These and other objects, features and advantages of this invention will become apparent to those skilled in the art after a reading of the following more detailed description.

PREFERRED EMBODIMENTS OF THE INVENTION

The present invention relates to an improved process of treating underexposed radiographs whereby the image quality of the film is intensified to a level at least equivalent to that of a fully exposed radiograph.

Generally, the process comprises irradiating any radiographic light sensitive material having a silver halide emulsion on a support member. Intensifying screens adjacent to the emulsion are not required for the successful practice of this invention. However, they may be employed as an additional means for radiation dose reduction. The underexposed light sensitive material is developed and fixed by conventional methods in the art and finally treated with the copper ion image enhancement composition to intensify the image density of the underexposed radiograph.

Broadly, the copper ion image enhancement composition which imparts a red-brown-like color to the radiographic image consists of an aqueous mixture comprising (1) at least one water soluble organic or inorganic salt of copper, (2) a water soluble ferricyanide salt and (3) a sequestering agent.

The copper salt may be virtually any inorganic or organic water soluble salt. Typical examples of suitable inorganic salts include copper sulfate, copper nitrate and copper halides, like copper chloride, bromide or iodide. In addition, amine complexes of copper can be used, as well as perchlorate salts, fluorosilicate salts, and the like. Water soluble organic salts of copper may include for example, copper formate, acetate, propionate, lactate, benzoate, oxalate, tartrate, citrate, etc. However, inorganic salts such as copper sulfate pentahydrate are preferred.

Ferricyanide salts include the water soluble alkali metal salts, usually potassium, sodium or lithium, as well as ammonium and quaternary ammonium salts.

Sequestering agents preferably include ammonium salts and alkali metal salts of citric, oxalic or tartaric acid, like potassium, sodium and lithium. However quaternary ammonium salts may likewise be used. Although salts of citric acid are preferred because of overall effectiveness and relatively low cost, it is permissible to employ other known sequestering agents such as EGTA (ethyleneglycol-bis-(beta-aminoethyl ether)-N,N,N',N'-tetracetic acid), nitrolotriacetic acid (NTA) and triethylenetetramine. Mixtures of the foregoing sequestering agents can also be used.

The primary purpose of the sequestering agent is to stabilize the enhancement composition and prevent immediate precipitation of insoluble cupric ferricyanide according to:

$$3\,Cu^{2+} + 2K_3Fe(CN)_6 \longrightarrow Cu_3Fe(CN)_6 + 6K^+ \quad (1)$$

potassium ferricyanide — cupric ferricyanide

The cupric ion sequestering agent may be designated as, L, and for the equilibrium, $$Cu^{2+} + L \rightleftharpoons [Cu^{2+}L] \quad (2)$$

a stability constant, K, may be usefully considered such that $$K = \frac{[Cu^{2+}L]}{[Cu^{2+}]\,[L]} \quad (3)$$

A large number of stability constant values for cupric ion sequestering agents have been published (for example in *Stability Constants of Metal Ion Complexes*, Smith and Martell, Special Publication No. 25, The Chemical Society, London, 1964).

The sequestering agents of choice for cupric ion will have values of K large enough such that the precipitation of cupric ferricyanide according to process (1) described above, is inhibited. However, the optimal sequestering agents will also have values of K small enough such that formation of cupric ferrocyanide is facilitated in the silver image of the radiograph. Within this optimal range of values of K, the following two processes occur in the silver image of the radiograph:

$$4\,K_3Fe(CN)_6 + 4\,Ag \longrightarrow Ag_4Fe(CN)_6 + 3K_4Fe(CN)_6 \quad (4)$$

potassium ferricyanide — silver ferrocyanide — potassium ferrocyanide $$K_4Fe(CN)_6 + 2[Cu^{2+}L] \longrightarrow Cu_2Fe(CN)_6 + 4K^+ + 2L \quad (5)$$

cupric complex — cupric ferrocyanide — sequestering agent

Thus if the stability constant K of the sequestering agent is too large, the sole process is represented by equation 4, where bleaching or loss in image density occurs.

In connection with the foregoing it has been found that certain cupric ion sequestering agents such as salts of oxalic acid, citric acid, tartaric acid and ammonia are effective in promoting image enhancement. Typically, for purposes of comparison, sequestering agents may have values of K in the region of about $10^4$ to $10^{16}$ $mole^{-1}$ liter. Certain salts of acetic acid, glycolic acids and diglycollic acid (oxydiacetic acid) with values of K below about $10^4$ were found to be ineffective. Immediate precipitation of cupric ferricyanide occurs according to equation (1) when formation of an image enhancement composition is attempted. Moreover, the precipitated mixture causes neither enhancement of radiographs according to the processes represented by equations (4) and (5), nor bleaching of the image (equation 4). Other factors affecting stability constant values include pH and temperature and the like.

Suitable copper ion image enhancement compositions for use according to this invention are also disclosed in *Photography, Theory, and Practice* by L. P. Clerc, 1930, page 366; *Photo Technique*, by John H. Waddell, June, 1939, on page 54; British Patent 163,337 and *Photographic Facts and Formulas* by E. J. Wall et al., 1976 on page 249.

Although copper image enhancement compositions are generally known in the photographic art, it has been found that underexposed radiographs according to the present invention can be enhanced in baths having a toning amount of copper salt, and more particularly, a molar concentration in a range from about 0.005 to about 5, and most preferably, from about 0.01 to 2.5.

Sequestering agents are ordinarily employed in the enhancement bath in an amount sufficient to sequester the copper ions. More specifically, the sequestering agent will range from about 1 to 100 times the molar concentration of the copper salt. Most preferably, sequestering agents are used in amounts from about 1.2 to 10 times the molar concentration of the copper salt.

The ferricyanide salt is employed in an image oxidizing amount, and more specifically in a range wherein the copper ion to iron ion molar ratio is generally from about 0.1 to 100, preferably, from 0.5 to 5.0, and most optimally the copper to iron ratio will range from about 1.1 to about 1.6.

Optimal image enhancement of a developed and fixed radiograph is obtained with an image enhancement bath pH generally ranging from 4.5 to 7.5, and more specifically from about 5.5 to about 7.0.

The rate of image enhancement is also influenced by image enhancement bath temperature which will ordinarily be at about ambient conditions. If bath temperatures are too low the rate of enhancement will be slow, and if too high, radiographic emulsions will swell and become too soft. A radiograph subjected to high temperatures will easily scratch, become distorted and stick to rollers in automatic processing equipment. Enhancement bath temperatures may generally range from 40° to 120° F., and most preferably, be from about 60° to 100° F.

As previously mentioned, the process of the present invention initially entailed exposing a photographic silver halide (bromide, iodide or chloride of silver) emulsion by irradiating in an amount sufficient to underexpose the film. This may be conveniently accomplished without requiring modification of X-ray equipment. For example, the exposure time may be reduced or the milliampere or kilovolt settings lowered.

The underexposed radiographic emulsion is developed and fixed by standard methods and procedures employed in processing fully exposed radiographic film. Separate developing and fixing baths are used, or alternatively, a combination type bath or mono-bath is permissible. Hydroquinone, glycin, paraminophenol, etc., based developing solutions are used with the customary preservatives and accelerators. Remaining silver salts are removed from the emulsion by fixing solutions which should be preferably free of chromium or other emulsion hardening agents. In this regard, it has been discovered that the use of certain hardeners in the developer inhibits penetration of the copper ion based image enhancement composition and reduces the rate and degree of intensification. In all instances, developing and fixing baths should be relatively fresh and replenishing solutions should be added from time to time to restore the balance of developer and fixer.

For purposes of this invention, fixation also includes the step of washing the processed film, which is conducted after fixation, or if fully processed film has been dried, it should preferably be rewashed before treating with the image enhancement composition. Washing serves to promote uniform image enhancement while insufficient washing may result in black "splotches" or reddish bands or non-uniform enhancement.

The developed and fixed radiographic image is then treated in the copper ion enhancement bath described above for a period of about ¼ to 10 minutes, depending on the enhancement bath composition, bath temperature and type of radiographic film. The radiographic film is subsequently washed in water and finally dried.

The following specific examples demonstrate the processes of the instant invention; however, it is to be understood that these examples are for illustrative purposes only and do not purport to be wholly definitive as to conditions and scope.

EXAMPLE I-PART A

Ten sheets of Dupont Cronex® 7, Radiographic Film were exposed to a source of X-rays using a phantom of a hand, a stepwedge, and a line pair resolution grid. Exposures were made using a Phillips M-80 Generator with a Machlette Dynamax X-Ray Tube having a 0.6 mm focal spot. A Kodak Regular Intensifying Screen was employed with a Kodak X-Omatic Cassette.

Two control X-ray films were exposed at 45 kilovolts peak (kVp) and 10 milliampere seconds (mAs).

The remaining eight films were exposed at 30% (3 mAs), 40% (4 mAs), 50% (5 mAs), and 60% (6 mAs) of the normal exposure used for the control radiographs. The films were developed by hand at a temperature of 91° F. for 1.5 minutes in D-19b developer having the following formulation:

metol—2.2 g
sodium sulfite (anhydrous)—72.0 g
hydroquinone—8.8 g
sodium carbonate (anhydrous)—48.0 g—D-19b Developer
potassium bromide—4.0 g
water to make—1 liter Following development, the films were treated in an acid stop bath followed by fixing in Kodak Rapid Fix, formulated without the hardener. The films were then washed for 5 minutes in water, and dried in air at room temperature.

Table A below provides the stepwedge densities of the films prior to image enhancement.

TABLE A*

| STEPWEDGE | FILM DENSITIES | | | | | | | | | |
|---|---|---|---|---|---|---|---|---|---|---|
| | CONTROL | | 30% | | 40% | | 50% | | 60% | |
| SEGMENT | #1 | #2 | #1 | #2 | #1 | #2 | #1 | #2 | #1 | #2 |
| 1** | 0.33 | 0.34 | 0.35 | 0.34 | 0.33 | 0.33 | 0.33 | 0.33 | 0.31 | 0.32 |
| 2 | 1.17 | 1.23 | 0.45 | 0.47 | 0.53 | 0.49 | 0.58 | 0.58 | 0.78 | 0.75 |
| 3 | 1.71 | 1.76 | 0.60 | 0.63 | 0.78 | 0.71 | 0.88 | 0.88 | 1.18 | 1.13 |
| 4 | 2.04 | 2.07 | 0.75 | 0.81 | 1.00 | 0.94 | 1.15 | 1.15 | 1.49 | 1.44 |
| 5 | 2.23 | 2.23 | 0.89 | 0.96 | 1.16 | 1.09 | 1.35 | 1.36 | 1.70 | 1.64 |
| 6 | 2.35 | 2.34 | 0.98 | 1.06 | 1.28 | 1.22 | 1.47 | 1.50 | 1.84 | 1.77 |

TABLE A*-continued

| STEPWEDGE SEGMENT | FILM DENSITIES CONTROL #1 | CONTROL #2 | 30% #1 | 30% #2 | 40% #1 | 40% #2 | 50% #1 | 50% #2 | 60% #1 | 60% #2 |
|---|---|---|---|---|---|---|---|---|---|---|
| 7*** | 2.55 | 2.55 | 1.22 | 1.33 | 1.58 | 1.50 | 1.77 | 1.76 | 2.14 | 2.05 |

*Table A data was obtained using a Tobias Densitometer Model TBX. Larger values in Table A represent darker image segments.
**Film base plus fog segment
***Denset image segment Table A densities show that the film pairs were exposed and developed with reasonable consistency. The 30% and 40% films exhibited poor image quality compared to the controls. The 50% film was more acceptable, but image quality was inferior to the controls. The 60% film was lighter overall, but exhibited nearly all the diagnostic information of the controls.

PART B

Except for the control films, films designated as #1 in Table A were enhanced, and those listed as #2 in Table A were set aside for qualitative image comparisons. The four (4) underexposed films (#1) of Part A, Example I were treated in the following image enhancement bath at 65° F. for 1 minute:

COPPER ION IMAGE ENHANCEMENT BATH cupric sulfate pentahydrate—19.6 g
potassium citrate—77.0 g
potassium ferricyanide—18.4 g
water to make—1 liter The bath was prepared by first dissolving the copper salt in 0.5 liter of water, followed by addition of potassium citrate, the ferricyanide salt dissolved in 100 ml. of water, and then enough water to make 1 liter of solution. The above composition has a $Cu^{2+}/Fe^{3+}$ molar ratio of 1.4.

Following the enhancement step, the films were washed for 5 minutes in water and dried.

Table B below provides data demonstrating that increased image density has occurred in each of the stepwedge segments.

TABLE B

| STEPWEDGE SEGMENT | ONE MINUTE ENHANCEMENT DENSITIES OF #1 FILMS 30% Film Density* | 30% Film % Inc.** | 40% Film Density* | 40% Film % Inc.** | 50% Film Density* | 50% Film % Inc.** | 60% Film Density* | 60% Film % Inc. |
|---|---|---|---|---|---|---|---|---|
| 1 | 0.43 | 23 | 0.41 | 24 | 0.41 | 24 | 0.38 | 23 |
| 2 | 0.59 | 31 | 0.72 | 36 | 0.82 | 41 | 1.14 | 46 |
| 3 | 0.83 | 38 | 1.12 | 44 | 1.29 | 47 | 1.71 | 45 |
| 4 | 1.08 | 44 | 1.45 | 45 | 1.68 | 46 | 2.06 | 38 |
| 5 | 1.27 | 43 | 1.65 | 42 | 1.91 | 41 | 2.33 | 37 |
| 6 | 1.41 | 44 | 1.79 | 40 | 2.03 | 38 | 2.57 | 40 |
| 7 | 1.73 | 42 | 220 | 39 | 2.47 | 40 | 3.04 | 42 |
| | Ave.*** 40% | | Ave.*** 41% | | Ave.*** 42% | | Ave.***41% | |

*Density of enhanced films.
**Percent increase over unenhanced films in Table A.
***Average percent increase, excluding film bae plus fog density values, (first stepwedge segment).

Table B demonstrates that enhancement of underexposed radiographs for 1 minute at 65° F. in the copper ion image enhancement composition, given above, results in a 40 to 42% average increase in image densities over the corresponding unenhanced films of Table A. The data also demonstrates that proportional enhancement has occurred.

Table B further shows in quantitative manner that the 60% film enhanced for 1 minute most closely compares with the control radiographs of Table A.

Qualitatively, comparing the phantom of the hand, the 30, 40, 50, and 60% enhanced radiographic images, were significantly improved over the corresponding unenhanced radiographs. Moreover, the 60% enhanced radiographic image was comparable in image clarity and detail to the control.

A further significantly important conclusion was drawn by comparing the line pair images on enhanced vs unenhanced pairs, namely, that the enhanced image at 50 lines per inch is clearly discernible. Thus degradation of image sharpness does not occur on enhancement in the copper ion bath to any appreciable extent.

PART C

The four (4) underexposed films (#1) of Part B which had been enhanced for 1 minute were further enhanced for an additional 1 minute in the same manner.

Table C below shows the effect of enhancement for a total of 2 minutes on the stepwedge segments.

TABLE C

| STEPWEDGE SEGMENT | TWO MINUTE ENHANCEMENT DENSITIES OF #1 FILMS 30% Film Density* | 30% Film % Inc.** | 40% Film Density | 40% Film % Inc.** | 50% Film Density* | 50% Film % Inc.** | 60% Film Density* | 60% Film % Inc.** |
|---|---|---|---|---|---|---|---|---|
| 1 | 0.45 | 29 | 0.44 | 33 | 0.44 | 33 | 0.40 | 29 |
| 2 | 0.63 | 40 | 0.76 | 43 | 0.87 | 50 | 1.21 | 55 |
| 3 | 0.88 | 47 | 1.16 | 49 | 1.34 | 52 | 1.80 | 53 |
| 4 | 1.15 | 53 | 1.49 | 49 | 1.73 | 50 | 2.13 | 43 |
| 5 | 1.35 | 52 | 1.71 | 47 | 1.94 | 44 | 2.38 | 40 |

TABLE C-continued

| STEPWEDGE SEGMENT | TWO MINUTE ENHANCEMENT DENSITIES OF #1 FILMS | | | | | | | |
|---|---|---|---|---|---|---|---|---|
| | 30% Film | | 40% Film | | 50% Film | | 60% Film | |
| | Density* | % Inc.** | Density | % Inc.** | Density* | % Inc.** | Density* | % Inc.** |
| 6 | 1.50 | 53 | 1.84 | 44 | 2.06 | 40 | 2.54 | 38 |
| 7 | 1.83 | 50 | 2.16 | 37 | 2.37 | 34 | 2.76 | 29 |
| | Ave.*** 49% | | Ave.*** 45% | | Ave.*** 45% | | Ave.*** 43% | |

*Density of enhanced films.
**Percent increase over unenhanced film in Table A.
***Average percent increase, excluding film base plus fog density values.

Table C shows that 2 minutes of treatment in the enhancement bath results in a 43 to 49% average increase in densities over the corresponding unenhanced films in Table A. Closer examination of Table C demonstrates that the lighter densities of the corresponding unenhanced films of Table A increase by up to 55% in density upon enhancement for 2 minutes.

Table C further demonstrates an unusual feature of this enhancement composition, namely, that prolonged enhancement for 2 minutes, causes the significantly darker densities to actually decrease in density compared with the 1 minute enhancement values. Simultaneously, the lighter density values increase. Thus valuable diagnostic image information in the darker regions is not lost on prolonged enhancement for 2 minutes.

Qualitatively, comparing the phantom of the hand, the 30, 40, 50 and 60% enhanced radiographic images were significantly improved over the corresponding unenhanced radiographs. Moreover, the 2 minute 50% enhanced image was improved in clarity over the 1 minute 50% enhanced image, and the 2 minute enhanced image approached the clarity and detail seen in the controls. The 60% image enhanced for 2 minutes was slightly closer in clarity and detail to the control phantom image, than the 60% image enhanced for 1 minute.

The line pair images on enhancement were clearly discernible at 50 lines per inch, demonstrating that image sharpness was not appreciably degraded.

Part C of Example I also favorably demonstrates that the process of the instant invention enables a reduction in radiation exposure of 60% with good image detail (see 40% film of Table C and compare with the 60% unenhanced film of Table A). Note that it has previously been stated that the 60% exposed film of Table A provides nearly all the diagnostic information of the fully exposed controls.

EXAMPLE II

A Dupont Cronex® 7, X-Ray Film was exposed as in EXAMPLE I to a stepwedge at 50% of the exposure given to the control which was normally exposed. The film was developed and fixed as in EXAMPLE I, Part A, and then enhanced at 70° F. in a bath, prepared as before, but consisting of 29.4 g cupric sulfate pentahydrate, 23.7 g potassium ferricyanide and 115.5 g of potassium citrate. The $Cu^{2+}/Fe^{3+}$ molar ratio for this bath was 1.6.

Table D lists densities of the stepwedge segment before enhancement and after 2 minutes and 8 minutes of enhancement.

TABLE D

ENHANCEMENT OF STEPWEDGE IN BATH WITH $Cu^{2+}/Fe^{3+} = 1.6$

| STEPWEDGE SEGMENT | FILM DENSITIES | | | | |
|---|---|---|---|---|---|
| | Prior to Enhancement | After Enhancement | | % INCREASE | |
| | | 2 min. | 8 min. | 2 min. | 8 min. |
| 1* | 0.29 | 0.35 | 0.39 | 21 | 34 |
| 2 | 0.78 | 1.12 | 1.19 | 44 | 53 |
| 3 | 1.08 | 1.53 | 1.53 | 42 | 42 |
| 4 | 1.26 | 1.82 | 1.70 | 44 | 35 |
| 5 | 1.41 | 2.04 | 1.84 | 45 | 30 |
| 6 | 1.50 | 2.14 | 1.91 | 43 | 27 |
| 7** | 1.67 | 2.42 | 2.04 | 45 | 22 |

*Film base plus fog segment
**Densest image segment

Table D shows that for a $Cu^{2+}/Fe^{3+} = 1.6$ bath composition, enhancement can be as high as 45% in 2 min. and 53% in 8 min. Excluding the film base plus fog segment (segment 1), the densities exhibit proportional intensification at 2 min., whereas at 8 min. there is not as great an increase in the higher density values as in the lower. This latter effect is useful for discerning detail in the high density values of an image upon enhancement.

EXAMPLE III

A Dupont Cronex® X-Ray Film was exposed as in EXAMPLE I to a stepwedge at 50% of the exposure given to the control, which was normally exposed. The film was processed as in EXAMPLE I, PART A, and then enhanced at 70° F. in an enhancement bath consisting of 19.6 g cupric sulfate pentahydrate, 7.5 g potassium ferricyanide, and 77 g potassium citrate. The $Cu^{2+}/Fe^{3+}$ molar ratio for this bath was 3.5. Enhancement was carried out for 0.5 min. as shown in TABLE E.

TABLE E

ENHANCEMENT OF STEPWEDGE IN BATH WITH $Cu^{2+}/Fe^{3+} = 3.5$

| STEPWEDGE SEGMENT | FILM DENSITITES | | |
|---|---|---|---|
| | Prior to Enhancement | After 0.5 min. | % INCREASE 0.5 min. |
| 1* | 0.28 | 0.31 | 11 |
| 2 | 0.94 | 1.07 | 14 |
| 3 | 1.26 | 1.46 | 16 |
| 4 | 1.48 | 1.72 | 16 |
| 5 | 1.61 | 1.86 | 16 |
| 6 | 1.69 | 1.94 | 15 |
| 7** | 1.83 | 2.12 | 16 |

*Film base plus fog segment
**Densest image segment

Table E demonstrates that for a $Cu^{2+}/Fe^{3+} = 3.5$ bath composition enhancement for 0.5 min. is proportional with an increase in image density occurring of about 16% over the unenhanced film.

EXAMPLE IV

A Dupont Cronex® X-Ray Film was exposed as in EXAMPLE I to a stepwedge at 60% of the exposure given to the control, which was normally exposed. The film was processed as in EXAMPLE I, PART A, and then enhanced at 68°-70° F. in an enhancement bath consisting of 19.6 g cupric sulfate pentahydrate, 25.7 g potassium ferricyanide, and 77.0 g potassium citrate. The $Cu^{2+}/Fe^{3+}$ molar ratio for the bath was 1.0. Enhancement was carried out for 0.5 min., 1.0 min., and 2.0 min. as described in TABLE F below.

TABLE F

ENHANCEMENT OF STEPWEDGE IN BATH WITH $Cu^{2+}/Fe^{3+} = 1.0$

| STEPWEDGE SEGMENT | FILM DENSITIES Prior to Enhancement | After Enhancement 0.5 min. | 1.0 min. | 2.0 min. | % INCREASE 0.5 min. | 1.0 min. | 2.0 min. |
|---|---|---|---|---|---|---|---|
| 1* | 0.29 | 0.33 | 0.36 | 0.38 | 14 | 24 | 31 |
| 2 | 1.03 | 1.47 | 1.50 | 1.47 | 43 | 46 | 43 |
| 3 | 1.36 | 1.73 | 1.85 | 1.65 | 27 | 36 | 21 |
| 4 | 1.57 | 1.94 | 1.99 | 1.89 | 24 | 27 | 20 |
| 5 | 1.71 | 2.28 | 2.21 | 2.09 | 33 | 29 | 22 |
| 6 | 1.79 | 2.36 | 2.29 | 2.19 | 32 | 28 | 22 |
| 7** | 1.90 | 2.55 | 2.40 | 2.29 | 34 | 26 | 20 |

*Film base plus fog segment
**Densest image segment

For a $Cu^{2+}/Fe^{3+} = 1.0$ molar ratio bath composition, TABLE F shows that enhancement can be as high as 43 to 46% over the original unenhanced image. Enhancement for 1.0 min. and for 2.0 min. actually causes a decrease in the darker densities compared with the density values exhibited for enhancement at 0.5 min. Thus this bath composition is useful for increasing image clarity in the lower density regions, while maintaining image clarity in the darker density regions.

EXAMPLE V

Six (6) Dupont Cronex® 7, X-Ray Films were exposed as in EXAMPLE I to a stepwedge at 50% of the exposure given to the control, which was exposed normally. The films were processed as in EXAMPLE I, PART A, and then enhanced at various bath temperatures from 60° F. to 105° F. for 0.5 min. The enhancement bath composition used is given in EXAMPLE I, PART B. Tables G and H below provide useful information on the role of temperature on enhancement.

TABLE G

ROLE OF ENHANCEMENT BATH TEMPERATURE ON THE MIDDLE STEPWEDGE SEGMENT

| Bath Temperature °F. | Stepwedge Densities* Before Enhancement | After 0.5 min. | Percent Increase |
|---|---|---|---|
| 60 | 1.53 | 2.01 | 31 |
| 70 | 1.59 | 2.12 | 33 |
| 82 | 1.53 | 2.24 | 46 |
| 90 | 1.51 | 2.18 | 44 |
| 105 | 1.59 | 2.46 | 55 |

*The values given are for the fourth (4) segment of each stepwedge.

TABLE H

ROLE OF ENHANCEMENT BATH TEMPERATURE ON THE FIRST STEPWEDGE SEGMENT

| Bath Temperature °F. | Stepwedge Densities* Before | After 0.5 min. | Percent Increase |
|---|---|---|---|
| 60 | 0.28 | 0.33 | 18 |
| 70 | 0.28 | 0.33 | 18 |
| 82 | 0.28 | 0.33 | 18 |

TABLE H-continued

ROLE OF ENHANCEMENT BATH TEMPERATURE ON THE FIRST STEPWEDGE SEGMENT

| Bath Temperature °F. | Stepwedge Densities* Before | After 0.5 min. | Percent Increase |
|---|---|---|---|
| 90 | 0.28 | 0.33 | 18 |
| 105 | 0.28 | 0.34 | 21 |

*Measured for the film base plus fog segment.

Table G shows that there is a marked increase in enhancement with increasing temperature, reaching a value of up to 55% in 0.5 min. at 105° F. Table H further demonstrates that enhancement under the conditions specified above results in little or no change in the film base plus fog density segment with increasing enhancement temperature. The latter result is important in maintaining good image contrast.

Automatic machine processing of X-Ray Films is typically carried out at elevated temperatures (85°-95° F.); hence, these copper ion image enhancement bath compositions may be conveniently employed at elevated temperatures in suitably modified automatic processors.

While the invention has been described in conjunction with specific examples thereof, these are illustrative only. Accordingly, many alternatives, modifications, and variations will be apparent to those skilled in the art in light of the foregoing description, and it is therefore intended to embrace all such alternatives, modifications and variations as to fall within the spirit and broad scope of the appended claims.

I claim:

1. A method for enhancing the image density of a radiograph, which comprises contacting an underexposed, developed and fixed radiographic film with a composition to intensify the image density profile of the radiograph, said composition comprising an aqueous mixture of at least one water soluble organic or inorganic salt of copper, a water soluble ferricyanide salt and a sequestering agent having a stability constant of sufficient value to prevent substantial precipitation of cupric ferricyanide in said composition and to enable formation of a cupric ferrocyanide-containing composition in said radiographic film.

2. The method of claim 1 wherein the sequestering agent is a compound selected from the group consisting of salts of citric acid, oxalic acid, tartaric acid and mixtures thereof.

3. The method of claim 1 wherein the sequestering agent is selected from the group consisting of salts of ammonia and primary amines.

4. The method of claim 2 wherein the sequestering agent is an alkali metal salt of citric acid.

5. The method of claim 4 wherein the alkali metal salt of citric acid is selected from the group consisting of sodium citrate and potassium citrate.

6. The method of claim 2 wherein the copper salt is a member selected from the group consisting of copper sulfate, copper nitrate, copper bromide, copper chloride and copper citrate.

7. The method of claim 6 wherein the copper salt is copper sulfate.

8. The method of claim 2 wherein the ferricyanide salt is a compound selected from the group consisting of alkali metal ferricyanides and quaternary ammonium ferricyanides.

9. A method for reducing the potential harmful effects of radiation resulting from radiographic diagnosis, which method comprises underexposing a radiographic film to radiation, developing and fixing the underexposed film and contacting the developed and fixed film with a composition to intensify the image density profile of the radiograph, said composition comprising an aqueous mixture of at least one water soluble organic or inorganic salt of copper, a water soluble ferricyanide salt and a sequestering agent having a stability constant of sufficient value to prevent substantial precipitation of cupric ferricyanide in said composition and to enable formation of a cupric ferrocyanidecontaining composition in said radiographic film.

10. The method of claim 4 wherein the sequestering agent is a compound selected from the group consisting of salts of citric acid, oxalic acid, tartaric acid and mixtures thereof.

11. The method of claim 4 wherein the sequestering agent is a compound selected from the group consisting of salts of ammonia and primary amines.

12. The method of claim 10 wherein the sequestering agent is an alkali metal salt of citric acid.

13. The method of claim 12 wherein the salt is selected from the group consisting of sodium citrate and potassium citrate.

14. The method of claim 10 wherein the copper salt is a member selected from the group consisting of copper sulfate, copper nitrate, copper bromide, copper chloride and copper citrate.

15. The method of claim 14 wherein the copper salt is copper sulfate.

16. The method of claim 15 wherein the ferricyanide salt is a compound selected from the group consisting of alkali metal ferricyanides and quaternary ammonium ferricyanides.

17. A method for enhancing the image density of an underexposed radiograph, which comprises contacting an underexposed, developed and fixed radiographic film with a composition comprising an aqueous mixture of at least one water soluble organic or inorganic salt of copper, a water soluble ferricyanide salt and a sequestering agent, said radiographic film having been treated with developing and fixing solutions substantially free of hardening agents.

18. The method of claim 17 wherein said sequestering agent is a material having a stability constant of sufficient value to prevent substantial precipitation of cupric ferricyanide in said composition and to enable formation of a cupric ferrocyanide-containing composition in said radiographic film.

19. The method of claim 18 wherein the sequestering agent is a compound selected from the group consisting of salts of citric acid, oxalic acid, tartaric acid and mixtures thereof.

20. The method of claim 19 wherein the sequestering agent is an alkali metal salt of citric acid, the copper salt is a number selected from the group consisting of copper sulfate, copper nitrate, copper chloride, copper bromide and copper citrate and the ferricyanide salt is a water soluble alkali metal salt.

21. The method of claim 20 wherein the copper salt is copper sulfate.

22. The method of claims 1, 9 or 18 wherein the sequestering agent is a compound having a stability constant in the region of about $10^4$ to about $10^{16}$ mole$^{-1}$ liter.

* * * * *